United States Patent [19]

Müller

[11] 4,069,765

[45] Jan. 24, 1978

[54] CABLEWAY SYSTEM AND PARTICULARLY SUPPORT SYSTEM THEREFOR

[76] Inventor: Gerhard Müller, Zipfelwiesenstrasse 7, Dietlikon, Switzerland

[21] Appl. No.: 637,675

[22] Filed: Dec. 4, 1975

[30] Foreign Application Priority Data

| | | |
|---|---|---|
| Dec. 10, 1974 | Switzerland | 16393/74 |
| Sept. 9, 1975 | Switzerland | 11663/75 |

[51] Int. Cl.[2] ..... B61B 12/02; E01B 25/18

[52] U.S. Cl. ..... 104/123; 14/18; 104/112; 191/41; 248/61; 404/1

[58] Field of Search ..... 104/89, 112, 113, 114, 104/115, 116, 117, 123, 124, 87, 93, 110, 173; 14/18, 19, 20, 21, 22; 248/61, 62, 63, 68 R; 191/41; 404/1

[56] References Cited

U.S. PATENT DOCUMENTS

| | | | |
|---|---|---|---|
| 470,992 | 3/1892 | Day et al. | 104/117 |
| 1,558,528 | 10/1925 | Wrenn et al. | 191/41 |
| 1,897,470 | 2/1933 | Forssell | 14/22 |
| 2,781,001 | 2/1957 | Davino | 104/89 |
| 3,541,964 | 11/1970 | Harbert et al. | 104/123 X |
| 3,604,361 | 9/1971 | Harbert et al. | 104/123 |
| 3,673,624 | 7/1972 | Finsterwalder et al. | 14/19 |
| 3,753,406 | 8/1973 | Müller | 104/123 X |

FOREIGN PATENT DOCUMENTS

| | | | |
|---|---|---|---|
| 431,364 | 7/1926 | Germany | 191/41 |
| 13,191 | 10/1901 | Sweden | 104/115 |

*Primary Examiner*—Robert J. Spar
*Assistant Examiner*—Randolph A. Reese
*Attorney, Agent, or Firm*—Flynn & Frishauf

[57] ABSTRACT

To prevent longitudinal displacement of the support or catenary cable and the load carrying, tensioned cable of the suspension system, the spacers or hangers between the catenary or support cable and the carrier cable, as well as the suspension and tension of these cables, are so arranged that, in side view, the two cables touch each other at the midpoint between the pylon to provide for equalization of tension in the cables. At that position, a tension or force equalization plate is clamped to both the support cable as well as to the carrier cable, thereby preventing relative longitudinal displacement of the cables with respect to each other. To provide for smoothing of a roller-suspended load over the cables, the carrier cable is preferably constructed of two parallel cable or rope elements, covered by a bowed or domed trackway which is resiliently supported on the cable elements, the resilient support having greater thickness in the region between spacers than at the zone of suspension, to additionally compensate for sag of the cables upon loading.

9 Claims, 7 Drawing Figures

1
2
3
3

1
2
3
3'
3'
4
5

1
2
3''
3''
3''
4
5

21
21'
22
22'
23
25
26
27
30
31
32
35
36
37
24
x
d
D

CABLEWAY SYSTEM AND PARTICULARLY SUPPORT SYSTEM THEREFOR

Cross reference to related patent: U.S. Pat. No. 3,753,406, by the inventor hereof.

The present invention relates to cable cars or cableways, or aerial tramways and more particularly to the support or suspension system for moving suspended aerial tramway cars or loads.

U.S. Pat. No. 3,753,406, by the inventor hereof, discloses a suspension and carrier system which is so arranged that the support or catenary cable is not relaxed or tension-released when a movable load is removed, so that the maximum loading of the support or catenary cable which arises when a movable load is intermediate of a zone subject to tension, is approximately the same as that in the remaining zones without any movable load thereat. In order to obtain this condition, which may be termed pre-stressing, or pre-loading of the support cable, the carrier cable on which the load actually is supported must be substantially pre-stressed. Practically it is necessary to form the carrier cable of at least two cable elements, or ropes (such as, for example, steel ropes) which have about double the cross-sectional area and double the tensile strength of the support or catenary cable. As the tension in the carrier cable increases, the differences in sag between the carrier cable upon presence or absence of a load become less. The movable load, if a single load, is distributed over a greater region of the tension zone, that is, the zone of the cable where the tension arises, when the carrier cable tension itself, is increased. Pre-loading or prestressing of the support cable is then obtained when the connecting elements or hangers or spacers within any tension zone — that is, the zone between pylons — transfer a distributed load formed by the average weight of the movable load plus the proportion of the weight of the spacer or hanger itself and the apportioned weight of the carrier cable. As a consequence, the pylons must be so constructed that they provide a downwardly directed force on the carrier cable, that is, to press the carrier cable downwardly. This is explained in detail in the aforementioned U.S. Pat. No. 3,753,406.

Basically, the structure includes a plurality of pylons on which a catenary or support cable is supported and a tensioned carrier cable is, in turn, supported by spacers or hangers from the catenary or support cable. The terminology used is that customary in the electric railroad art. The spacers are so dimensioned that the carrier cable is held in an upwardly bowed or upwardly curved condition so that, upon loading by the movable load, the carrier cable will flatten out or stretch to be essentially flat. The tension of the carrier cable is at least twice the tension in the support cable; the sum of all the tensions or forces in the spacers between two adjacent pylons is approximately equal to the weight of the carrier cable and the average load carried thereon. The force required to hold the carrier cable down, applied at the pylons, corresponds approximately to the average movable load.

The system, as described in the aforementioned patent, thus provides a suspension arrangement in which, due to prestressing of the support cable, up to about 75% of the sag and tension differences arising in suspension systems of the prior art could be eliminated. The remaining sag had to be accepted and had to be compensated by a stiff pylon or support construction; otherwise, when using self-aligning or self-adjusting supports or swing supports, a longitudinal shift between the carrier cable and the support cable arose in adjacent zones between adjacently located pylons. This longitudinal shift between the cables became additive; the sag in the support cables was increased by loading the carrier cable, requiring additional cable length; simultaneously, the rise, that is, the upwardly directed bowing of the carrier cable decreased. Keeping the carrier cable tension constant, an increase in the length thereof resulted. This longitudinal shift, due to the tension relationships, had as a result that the normally vertical hangers change to an inclined direction; distributed over a plurality of zones between the pylons, the tension equalized, and the relative shift of the cable also decreased. It is difficult to express this change in vertical position of the spacers, and the shift in length of the cable in mathematical terms. The situation is further impaired when the cableway is long and supports a plurality of movable loads.

It is an object of the present invention to further improve the cableway arrangement of the aforementioned patent, and to provide a cableway system, and particularly a suspension system, in which longitudinal shift between the support cable and the carrier cable for the load itself is essentially eliminated.

SUBJECT MATTER OF THE PRESENT INVENTION

Briefly, the cables are so suspended with respect to each other that, looked at in side view, the curves of the support or catenary cable and of the carrier cable touch each other at points midway between pylons; at those touching points, at least one force equalization element, preferably a tension equalization plate, is located, clamped to both the support cable and to the carrier cable, and preventing relative shift of the cables with respect to each other. Arranging the cables as aforesaid simplifies the static positioning of the cables and renders it more precise. The pylons can be constructed with lesser height — given a predetermined height of the carrier cable above ground level — and the hangers or spacers need no longer be constructed to permit slanting thereof. Their lower connection no longer requires ball joints. The entire suspension system has a slimmer appearance; the surface subject to wind loading is decreased. The length of the cableway no longer has any influence on the static or dynamic behavior of the cable supports; more than one movable load can be supported by the carrier cables at any zone, between pylons.

The actual carrier cable is constructed preferably by two times two cable elements, arranged in pairs, two cable elements of a pair, each, being spaced from the others of the other pair by cross ties which also maintain the track width of the pairs of cable elements with respect to each other. The spacers then connect the cross ties to the catenary or support cable.

The invention will be described by way of example with reference to the accompanying drawings, wherein:

FIGS. 1, 2 and 3 correspond essentially to FIGS. 1, 2 and 3 of the aforementioned U.S. Pat. No. 3,753,406 and illustrate:

In FIG. 1 a side view showing the principal tension relationships in a support cable and carrier cable, FIG. 2 the tension relationships having a support cable, a carrier cable and a hanger system, with a load attached, in a suspension bridge arrangement, and FIG. 3 the system which is basic to the concept of the present invention;

Basically, the support system (FIG. 1) is supported by pylons 3 on which a support or catenary cable 1 is suspended which, in turn, supports a carrier cable 2 forming the actual trackway or driveway for the load, and on which a load is movable. The cables 1 and 2, the region between the end points and the next adjacent pylon, and the region between the pylons 3 themselves, are designated herein as the span zones, or as the tension zones. In unloaded condition, the support or catenary cable 1 has little tension therein. The cable 1, thus, has substantial sag or hang-through in the span zones. The carrier cable 2, however, has only little sag when unloaded. It is subject to high tension. Except for the tension, the weight of the support cable as well as the weight of the carrier cable is fully accepted by the pylons 3.

Figures 1, 2, 3:
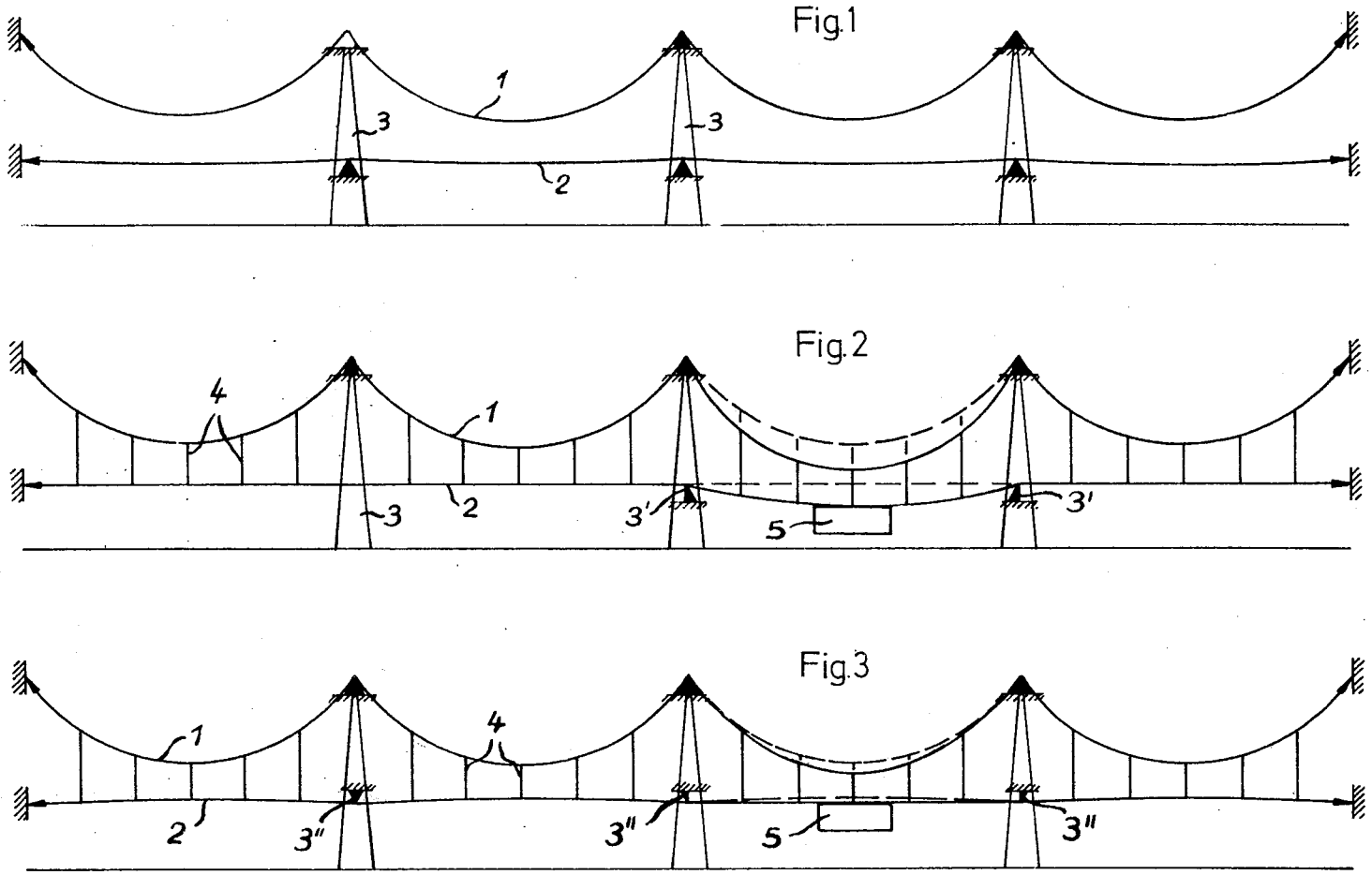

Connecting elements, that is, hangers or spacers 4 support, as seen in FIG. 2, the carrier cable 2 on the catenary cable 1. No forces from the carrier cable 2 will arise on the pylons 3 when the carrier cable 2 is in unloaded condition. This is the general condition in suspension bridges and, in general, in the overhead or trolley or catenary system in main line electric railways. If, then, a movable load 5 is placed on the carrier cable 2, the catenary cable 1 as well as the carrier cable 2 will sag in the respective span zone, as clearly seen in FIG. 2. The weight of the load 5 then must be accepted by the adjacent pylons 3'. To provide for the sag, cable 2 is pulled over from adjacent spans which, as previously noted, causes damage to the cable and slanting or skewing of the spacers 4.

The system used in accordance with the present invention is illustrated in FIG. 3, in which the hangers 4 are so arranged that they pull the carrier cable 2 and the catenary cable 1 towards each other, while the carrier cable 2, itself, is maintained under substantial tension. The forces are so arranged that the sum of the tensions in all spacers 4 corresponds to the weight of the carrier cable (and such additional structure as may be associated therewith) plus the average weight of the movable load. As a result, upwardly directed forces will arise at the pylons 3" corresponding approximately to the average movable load. These upwardly directed forces must be accepted by holding systems to press the carrier cables 2 downwardly.

The customarily used structures correspond, essentially, to the suspension bridge arrangements in which the pylons do not, however, have to transmit hold-down forces. The pylons need not transfer any upwardly directed forces, that is, to hold bowed elements down, and the catenary cables have to transfer only the weight of the roadway or other surface, even if the roadway is upwardly bowed when empty of traffic thereover.

The upward bowing or rise of the carrier cables upon a distributed traffic load becomes less as the tension in the cables is increased. In practical arrangements, the tension in the carrier cable should be at least twice that as the maximum tension in the catenary cable 1.

If a movable load 5 is placed on the system of FIG. 3, then a relatively small increase in the tension of the catenary cable 1 causes drop or sag of the carrier cable 2. The weight previously applied to the catenary cable 1 corresponding to the weight of the movable load, in addition to the weight of the carrier cable 2 itself is now eliminated, and is replaced by the actual load. This, however, unloads the pylons 3". If the actual weight of the movable load is equal to the average weight then, under a pylon 3", the weight due to the load actually will be zero. In contrast to the known constructions, therefore, passing of a load across a pylon will not be noticed at all.

The foregoing arrangement of the catenary cable and of the carrier cable permitted elimination of the previously noted sag and tension differences up to 75% thereof. In accordance with the present invention, and to further improve the tension relationships and the running smoothness of movable loads, the catenary cable and the carrier cable are so arranged that, looked at in side view, the cables touch each other. At these touching points or zones, force equalization plates are provided, as explained in connection with FIGS. 4 and 5.

Figure 4:
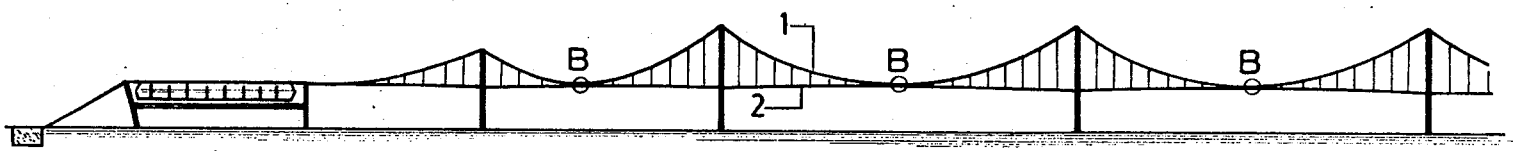
FIG. 4 is a highly schematic representation, in side view, of the suspension support system in accordance with the present invention.

The support system in accordance with FIG. 4 is subdivided into four spans or span zones. At contact points B, the catenary cables 1 and the carrier cables 2 are at the same elevation.

Figure 5:
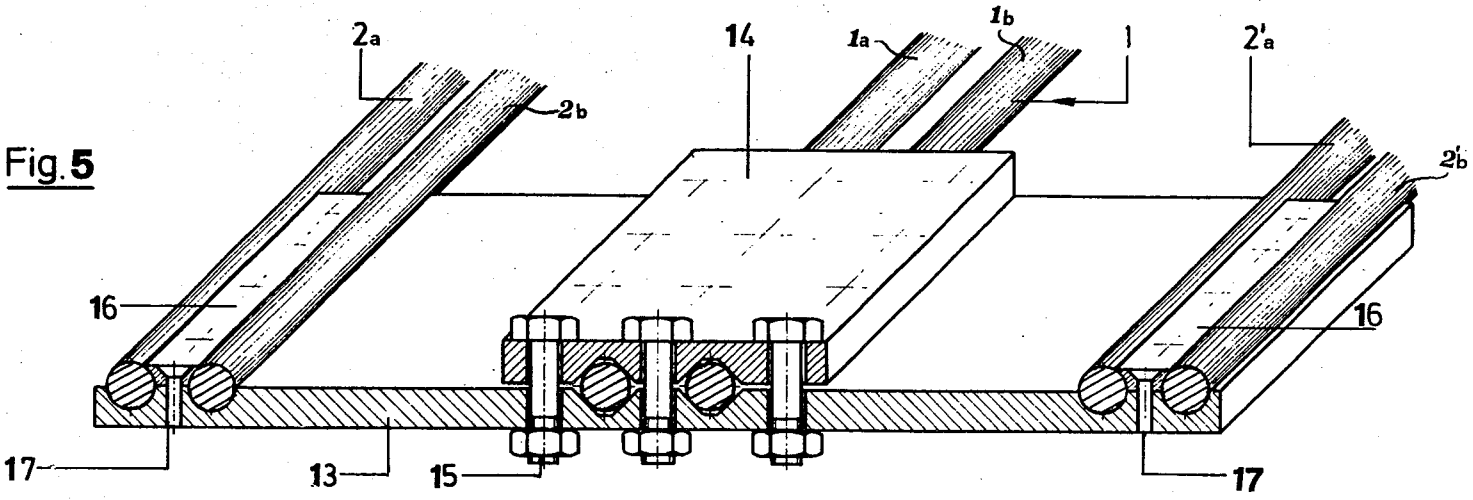
FIG. 5 is a part sectional, part perspective view, to a greatly enlarged scale, of an equalization plate.

A force equalization plate 13 is shown in FIG. 5, by way of example. Such a plate may be applied at the points B (FIG. 4) centrally within the span zones. Plate 13 is suitably grooved to accept the various cable or rope elements of the catenary cable 1 and the carrier cable 2. The catenary cable 1 is formed of two cable elements 1*a*, 1*b*, located and running parallel to each other. At the edges of the plate, two each carrier cable elements 2*a*, 2*b*, 2'*a*, 2'*b* are located. The various cable elements are clamped in conventional manner, that is, the catenary cable elements 1*a*, 1*b* are secured by means of a clamping plate 14 and clamping bolts 15 passing therethrough. The carrier cables 2 should have top surfaces engageable by wheels or sheaves of the movable load and, therefore, they are located in milled grooves in the plate 13, and held in position by means of wedges 16 which are secured by means of screws 17 to plate 13, to clamp the individual elements of the cables 2 to the plate 13.

Figures 6, 7:
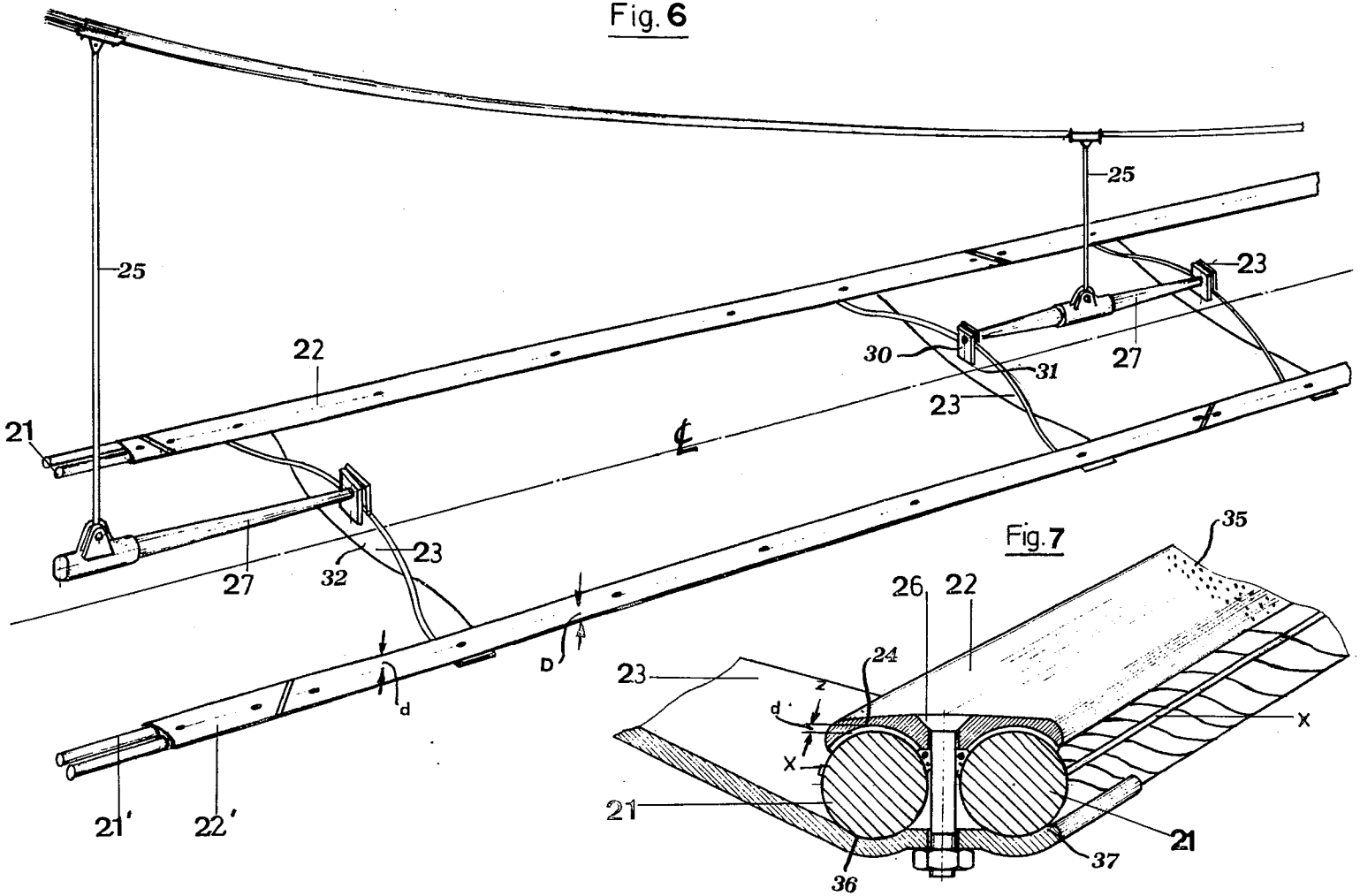
FIG. 6 is a perspective, schematic view of a flexible trackway for the system of FIG. 4.
FIG. 7 is a part sectional, part perspective view of a flexible track connection to a cross tie, to a greatly enlarged scale, and showing a fragment of the arrangement of FIG. 6.

FIG. 6 illustrates two pairs 21, 21' of cable elements covered by a running surface 22, 22' respectively, to form suspended tracks. The cable element pairs 21, 21' are secured at suitable distances to cross ties 23, similarly to the attachment of the cable elements 2*a*, 2*b*, to the force equalization plate 13 (FIG. 5). The pairs 21, 21' may also be attached to other suitable surfaces, such as rigid cross ties, for example adjacent termination of the suspension system. An elastic layer 24 (FIG. 7), for example of plastic, is located between the cover forming the surface 22. This cover may be of metal, such as steel, or of plastic. The thickness of the intermediate resilient layer 24 varies. In the region of the cross ties 23, or of the spacers 25, respectively, the layer 24 is comparatively thin, having the dimension *d* (FIG. 7). In the region intermediate two cross ties or spacers 4, respectively, the thickness of the resilient layer 24 increases, to a dimension D (FIG. 6). The intermediate layer 24, when unloaded, therefore provides for slight superelevation of the running surface formed by the cover 22.

The covers 22 are secured to the cross ties 23 by means of screws or rivets 26 (FIG. 7). The cross ties 23 are pivotally attached to a rod 27 which has some resiliency, and which, in turn, is pivoted to the spacers 25, as clearly seen in FIG. 6. The surface cover 22 is also connected to the respective cable pair intermediate the attachment to the cross ties, as seen in FIG. 6, for example by utilizing a wedge similar to wedge 16 (FIG. 5). The attachment of the flexible trackway formed of the cable pairs and the running surface to a cross tie is best seen in FIG. 7. Using two cable elements to form a pair 21, rather than a cable of equal cross-sectional area, has substantial advantages in original manufacture, assembly, and transport for installation. An additional and substantial advantage is the increased flexibility of the trackway, since the torsion forces caused by pressure of the wheels or rollers passing thereover, and on which the load is suspended, are decreased. It is also possible to secure the individual cable elements of the cable pairs with respect to all directions without interfering with the profile of the trackway on which the rollers or wheels of the movable load have to operate.

The cross ties 23 and the pivotal rod 27 are secured to a pivot connection above the center line CL of the cross ties, as seen at 30 (FIG. 6) where the cross ties are positively loaded. If the loading changes between positive and negative directions (that is, vertically upwardly or downwardly, respectively), then the attachment point is preferably located at the center point 31, FIG. 6; if the loading is clearly always in negative direction, then the attachment point is preferably below the center line, as illustrated at 32, FIG. 6.

The running surface cover 22 is extended over the edge of the cable elements of the cable pairs 21, 21', respectively, and is domed or bowed in cross section. This improves the guidance of the wheels or rollers for the movable load. The surface can also be covered with friction increasing or friction decreasing coating or other applied material, such as, for example, sand 35, particularly at those points where the movable load is to be braked. The space between the individual cable elements of the cable pairs can be electrically heated by introducing heating wires 36. The narrowest point between the cable elements of the cable pairs is formed with a seal 37 to protect the heating wires. The cover 22, 22', and particularly when extended over both cable elements of the cable pairs and domed substantially improves the running smoothness of a movable load; the partial pressure of the wheels on the surface is reduced, as are losses due to friction and kneading and flexing of the individual cable elements of the cables. Heating of the cables upon passing of the movable load over a particular point is also decreased. The top of the cable elements is protected; below this protection, and due to the relatively wide track surface, electrical insulation material can be applied, and additional wires, such as electrical power supply, or control wires for the movable load can be attached. The same profile of the running surface can also be used for rigid track sections, for example in curves, for track switches, stations, layover tracks, or track sections, or on fixed rigid constructions without a cable, and to which the cable suspension is joined.

The elastic intermediate layer 24 is preferably adhered to the respective top cover 22, 22' before being covered; the cable elements are coated, for example by painting, with a rust-preventive paint. It is necessary to permit removal of the cover, at least in part, in order to permit checking of the integrity of the cables and the cable elements. A quick and ready check can be effected, without the laborious removal of the cover, by painting each of the cable elements with a control strip at the position marked *x* (FIG. 7). If any wires should break, the cable will shift position; this shift may be in the order of about 1 cm. This shift results in a well visible and clearly observable break of the painted strip, even if the break point itself is hidden beneath the top covers 22. The top covers 22 themselves are not stressed under tension, or only insignificantly so; for ease of assembly it is preferred to make them in rather short lengths, for example about the distance between hangers 25. To provide for smooth running of the rolling load, the joints do not extend transversely to the cable elements 21, 21' but rather extend at an angle of, for example, 30° to 45° with respect to the longitudinal axis of the cable, leaving a small gap similar to an expansion joint.

The elastic intermediate layer 24 is not strictly necessary; it is also not necessary to form the intermediate layer 24, if used, of variable thickness; if used, strips having different thicknesses, or other supports between the cable elements of the cable pairs 21, 21', respectively, and the running surface can be used, the increase in thickness being so arranged to compensate for sag or hang-through of the cable between the hangers.

Various changes and modifications may be made within the scope of the inventive concept.

I claim:

1. Support system for a cableway or cable car system to transport a movable load (5) thereover comprising a plurality of pylons (3);

a catenary or support cable (1) supported on the pylons (3);

a tensioned carrier cable (2) on which the movable load (5) is suspended for movement along the carrier cable (2) while being supported thereby, said carrier cable (2) including at least two individual cables (2, 2'; 21, 21');

cross ties (23) connecting the two individual cables, spaced from each other, whereby two individual cables form a trackway, connecting rods (27) located intermediate the individual cables, connecting two adjacent cross ties and pivotally connected to said cross ties;

spacers (4) suspending and supporting the carrier cable (2) from the support cable (1), said spacers being dimensioned to maintain the carrier cable in upwardly bowed condition when unloaded, and to assume an approximately straight or level state when loaded by the load (5) and being pivoted to said connectings rods (27) to support said connecting rods, and hence said cross ties (23), and hence the trackways;

the tension in the carrier cable (2) being at least twice the tension in the support or catenary cable (1), and the sum of all tensions in the spacers (4) between adjacent pylons (3) being approximately equal to the weight of the carrier cable (2) plus the weight of the average load, whereby a downwardly directed force will arise at the pylons with respect to the carrier cable and which corresponds approximately to the average load, the cables (1, 2) being relatively so tensioned and arranged that, in side view, the curve formed by the support or catenary cable (1) and the curve formed by the carrier cable (2) touch each other midway between the pylons to provide for equalization of tension in said cables;

at least one force equalization plate (13) located intermediate the pylons (3) at the touching location;

and clamping means (14, 15; 16, 17) secured to said force equalization plate (13) and in clamping engagement with both said support cable (1) and said carrier cable (2)

and clamped to and connecting together both the support cable (1) and the carrier cable (2) to prevent relative longitudinal displacement of said support cable (1) and said carrier cable (2) with respect to each other.

2. System according to claim 1, wherein the pivot connecting point between the cross ties (23) and the connecting rod (27) is located with respect to the center line of the cables in this relationship: at positive loading of the cross ties, the connecting pivot is above the center point of the cable; at negative loading of the cross ties, the connecting point is below the center line of the cable; and with variably positive and negative loading of the cross ties, the connecting pivot point is at the same level as the center line of the cable.

3. Support system for a cableway or cable car system to transport a movable load (5) thereover comprising a plurality of pylons (3);

a catenary or support cable (1) supported on the pylons (3);

a tensioned carrier cable (2) on which the movable load (5) is suspended for movement along the carrier cable (2) while being supported thereby, said carrier cable including at least two cable elements (*2a, 2b; 2'a, 2'b*) located adjacent each other, a trackway cover (22, 22') above said cable elements to form a running surface for the movable load to operate thereover;

a resilient intermediate layer (24) between the trackway cover (22) and the cable elements (*2a, 2b; 2'a, 2'b;* 21, 21'), spacers (4) suspending and supporting the carrier cable (2) from the support cable (1), said spacers being dimensioned to maintain the carrier cable in upwardly bowed condition when unloaded, and to assume an approximately straight or level state when loaded by the load (5), the thickness of the intermediate resilient layer (24) varying along the length of the system and being arranged to compensate for sag of the cables between the spacers (4);

the tension in the carrier cable (2) being at least twice the tension in the support or catenary cable (1), and the sum of all tensions in the spacers (4) between adjacent pylons (3) being approximately equal to the weight of the carrier cable (2) plus the weight of the average load, whereby a downwardly directed force will arise at the pylons with respect to the carrier cable and which corresponds approximately to the average load, the cables (1, 2) being relatively so tensioned and arranged that, in side view, the curve formed by the support or catenary cable (1) and the curve formed by the carrier cable (2) touch each other midway between the pylons to provide for equalization of tension in said cables;

at least one force equalization plate (13) located intermediate the pylons (3) at the touching location;

and clamping means (14, 15; 16, 17) secured to said force equalization plate (13) and in clamping engagement with both said support cable (1) and said carrier cable (2)

and clamped to and connecting together both the support cable (1) and the carrier cable (2) to prevent relative longitudinal displacement of said support cable (1) and said carrier cable (2) with respect to each other.

4. System according to claim 3, wherein the resilient intermediate layer (24) is secured to the trackway cover (22) and is loose with respect to the cable elements (*2a, 2b; 2'a, 2'b;* 21, 21') of the carrier cable (2).

5. System according to claim 3, wherein the trackway covers (22, 22') are unitary elements extending between the spacers (4), the joints between adjacent trackway cover elements forming a small gap and being inclined with respect to the major longitudinal direction of the carrier cables (2).

6. System according to claim 3, further comprising a surface coating (35) located on selected zones at the upper surface of the trackway covers (22, 22').

7. System according to claim 3, further comprising sealing means (37) located beneath the trackway covers (22) and the cable elements (21), and heating means (36) located in the sealed space between the cable elements and the trackway cover (22, 22').

8. System according to claim 3, wherein the upper surface of the trackway covers (22, 22') is bowed or domed, and the edges thereof are rounded.

9. System according to claim 8, wherein the rounding radius of the edges of the domed trackway covers (22, 22') has a smaller radius of curvature than the radius of the cable elements (*2a, 2b; 2'a, 2'b;* 21, 21') of the carrier cable (2).

* * * * *